United States Patent [19]

Astolfi

[11] Patent Number: 4,509,278

[45] Date of Patent: Apr. 9, 1985

[54] CLIP FOR PORTRAIT FRAMES AND THE LIKE

[75] Inventor: Pietro Astolfi, Bologna, Italy

[73] Assignee: Pico-Glass S.p.A., Italy

[21] Appl. No.: 494,654

[22] Filed: May 16, 1983

[30] Foreign Application Priority Data

Feb. 11, 1983 [IT] Italy ..... 4746/83[U]

[51] Int. Cl.[3] ..... A47G 1/06; G09F 1/12

[52] U.S. Cl. ..... 40/156; 248/490

[58] Field of Search ..... 40/156, 157, 152, 155, 40/11 R, 23 R; 248/490, 488

[56] References Cited

U.S. PATENT DOCUMENTS

| | | | |
|---|---|---|---|
| 1,763,024 | 6/1930 | Underhill et al. | 40/23 R |
| 2,593,195 | 4/1952 | Rosenberg et al. | 40/152 |
| 3,349,443 | 10/1967 | Sury | 248/490 |
| 3,541,714 | 11/1970 | Bruck | 40/156 |
| 3,981,091 | 9/1976 | Wiener | 40/156 |
| 4,217,710 | 8/1980 | Becker | 40/156 |
| 4,391,053 | 7/1983 | Anthony | 40/157 |

FOREIGN PATENT DOCUMENTS

| | | | |
|---|---|---|---|
| 150369 | 8/1937 | Austria | 40/152 |
| 2446630 | 4/1976 | Fed. Rep. of Germany | 248/490 |

*Primary Examiner*—John J. Wilson

*Attorney, Agent, or Firm*—Darby & Darby

[57] ABSTRACT

A clip for portrait frames and for framing components in general includes a metal strip that deforms elastically and is so shaped as to wrap around one edge of a portrait frame, a first terminal part of the clip is in contact with the front surface of the portrait frame, and a second terminal part of the clip, at the opposite end to the former, is engageable in a slot formed in the outer surface of the back part of the frame.

4 Claims, 6 Drawing Figures

FIG1
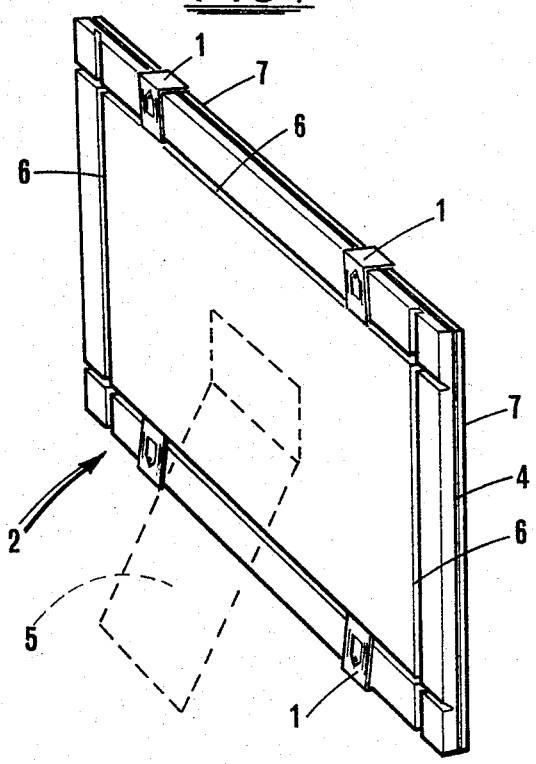
FIG2
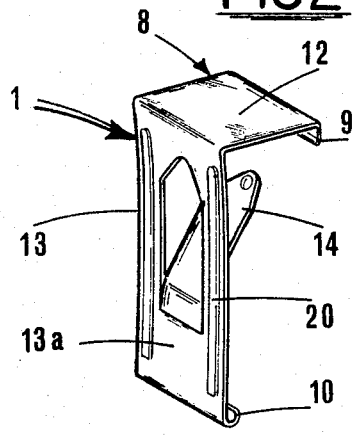
FIG4
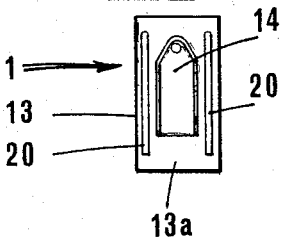
FIG5
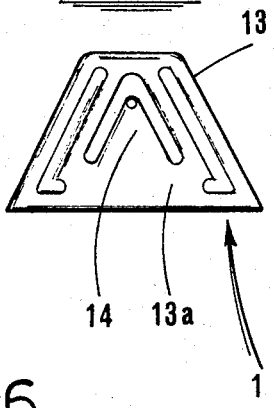
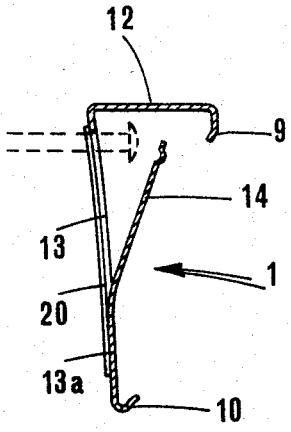
FIG3
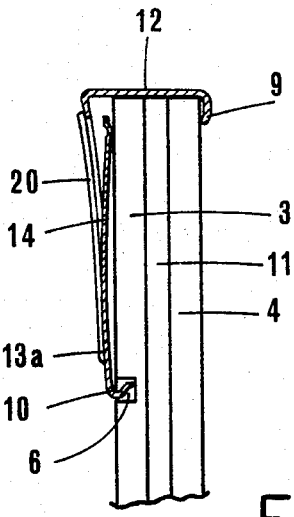
FIG6

CLIP FOR PORTRAIT FRAMES AND THE LIKE

BACKGROUND OF THE INVENTION

The invention relates to an improved clip for portrait frames and the like.

DESCRIPTION OF THE PRIOR ART

As is known, the most straightforward portrait frames, namely the ones utilized as means for supporting or displaying in a simple fashion portraits, photographs and drawings, are constituted by a back part, made for example of ordinary cardboard, a sheet of glass of the same size as the back part, and clips that restrain elastically therebetween, the back part and the transparent sheet of glass. Under the action of the clips, the photograph, portrait or picture to be displayed is held tightly between the back part and the transparent sheet of glass.

In the most popular and most efficient embodiment of the said clips, they take the form of a metal strip that deforms elastically and wraps around the portrait frame in the region of one of the edges thereof.

The strip is shaped in such a way that at the time it is being inserted, an elastic locking action is applied, while in the region of the back part, one end of each strip is bent to enable it to be inserted into a slot in order to stabilize the position reached.

The slot can be equivalently substituted by a depression in the back part of the portrait frame.

Clips of the type briefly described above are efficient when a particularly thin item, for example a sheet of paper or a photograph, is inserted between the back part and the transparent sheet of glass.

In such a case the overall gage of the portrait frame varies by only a little with respect to the original thickness and the clips are not flexed beyond the envisaged theoretical value.

It can happen, instead, that a notably thick item, such as a piece of cardboard or the like, is inserted between the back part and the transparent sheet of glass and in such an instance the said clips are inadequate to since not only do they lose their shape to a considerable extent but also they tend to get out of position on the portrait frame and, consequently, to lose their locking action.

Besides reducing the reliability of the portrait frames formed in the way outlined above, the problem obliges manufacturers to produce a large number of variously sized clips in order to keep it in check.

It is obvious, however, that a considerable diversification of the said clips has an adverse effect on their manufacturing costs.

SUMMARY OF THE INVENTION

The general object of the invention is to put an end to the aforementioned negative situation through the creation of a new clip which, within certain limits, is virtually insensitive to deviations with respect to the thickness envisaged for the portrait frames.

Within the framework of the general object, one important aspect of the invention is to create a clip that is simple, inexpensive and can easily be produced by firms in the field in question.

Another object of the invention is to create a clip, the structure of which can also be in various forms to suit the different types of portrait frames in existence.

A further important object of the invention is to create a clip that can also be utilized as the means with which to hang and support the frame on the wall.

These objects and others too that will become more apparent hereinafter are attained with the improved clip according to the invention, for portrait frames and the like, of the type constituted by a metal strip that deforms elastically and is so shaped as to wrap around one edge of the a portrait frame and to place a first terminal part in contact with the front surface of the frame, and to place a second terminal part at the opposite end to the former, in the region of a slot made in the outer surface of the back part of the frame. The strip, in the non-operative position, is defined, in between the terminal parts, by two virtually flat sections which form, one with the other, an angle of less than 90° . The sections include a covering section, to be placed adjacent to one of the edges on the frame, and a rear section, to be placed adjacent to the back part of the frame, the latter section being provided at one extremity with an integral pressure tongue placed oblique thereto.

BRIEF DESCRIPTION OF THE DRAWINGS

Further characteristics and advantages of the invention will emerge more clearly from the description of one preferred embodiment for the clip, illustrated purely as an unlimited example on the accompanying drawing, in which:

FIG. 1 shows diagrammatically, in a perspective rear view, a portrait frame provided with clips according to the invention;

FIG. 2 shows, in a perspective view, a clip according to the invention;

FIG. 3 shows a medial vertical section of the clip depicted in FIG. 2;

FIGS. 4 and 5 show the clip depicted in FIGS. 2 and 3 upright from the rear, shaped in the form of a strip and in the form of a triangle, respectively; and FIG. 6 shows the clip according to FIG. 3 in position mounted on a portrait frame.

DESCRIPTION OF THE PREFERRED EMBODIMENT

With reference to the figures listed above, at 1 is shown the clip according to the invention which, as shown in FIGS. 1 and 6, can be seen to have been mounted on a portrait frame 2 of a fully commonplace type, made up of a back part 3, a transparent sheet of glass 4, virtually of the same size as the back part 3, and possibly of a support element 5 that can be formed in any way but in the description given herein is constituted by a flap that rests the portrait frame on a table.

The back part 3 is provided, in a way in itself known, with slots 6 parallel to the edges 7 of the portrait frame 2. The slots 6 can naturally be functionally replaced by a depression made centrally in the back part 3.

The clips 1 are formed by a metal strip that deforms elastically, 8, bent in such a way as to wrap around an edge 7 of the portrait frame 2.

The strip 8 is provided with a first terminal part 9 placed in contact with the transparent sheet of glass 4, and with a second terminal part 10 that is inserted in the slot 6 in the region of the back part 3.

The transparent sheet of glass 4 and the back part 3 are pressed together by the strip 8 with a thin element 11 to be displayed, for example a photograph, trapped in between them.

The strip 8 is originally defined, in the non operative position, as shown in particular in FIGS. 2 and 3, by two virtually flat sections to which belong the terminal parts 9 and 10, one oblique with respect to the other in such a way as to form an angle close to but less than 90°. The strip 8 is substantially in the form of a "7" and the aforementioned sections, one oblique with respect to the other, define a covering section 12 that is placed adjacent to an edge 7 on the portrait frame 2, and a rear section 13 that is placed adjacent to the back part 3 of the portrait frame 2.

Furthermore, it is advantageously envisaged that the rear section 13 of the strip 8 be integral with one extremity of a pressure tongue 14 placed obliquely with respect to and overhanging the rear section 13. The pressure tongue 14 is preferably formed by cutting it out of the rear section 13 and advantageously bending the tongue in such a way that it points towards the covering section 12 of the strip 8.

In this way, jointly with a part 13*a* of the rear section 13 adjacent to the second terminal part 10, the pressure tongue 14 defines a compensating or fork element (FIG. 3) that tends to maintain the outline of the tongue virtually constant and, in particular, the degree of divarication between this and the part 13*a*, as will be clarified better in relation to FIG. 6.

FIGS. 4 and 5 show that the rear section 13 can have any profile. This also applies as regards the pressure tongue 14 which can, for example, be rectilinear or trapezoidal. In the latter case (FIG. 5), the second terminal part 10 is particularly long and thus the clip is suitable for use on portrait frames of large size or in cases where one single clip is used for each edge 7 of the portrait frame 2. This enables the clip to serve, furthermore, as the sole means for hooking the frame onto the wall, utilizing the aperture created by bending the pressure tongue 14 (see FIG. 3).

It is also important that bilaterally to the tongue 14, two ribs 20 are provided along the rear section 13 in order to increase the elastic resistance of the section.

The operation of the improved clip according to the invention is given particular emphasis in FIG. 6, from which it can clearly be seen that when the clip 1 engages a portrait frame 2, the inclination varies between the covering section 12 and the rear section 13 of the strip 8: the sections diverge, one with respect to the other, until an angle very close to 90° is reached.

The pressure and the coupling effect continue to be particularly energetic in every situation since two pressure areas are provided on the back part 3, that is to say, one in the region of the second terminal part 10 and the other in the region of the pressure tongue 14.

Original above all is that the coupling effect remains unvaried as the sections 12 and 13 of the strip 8 fork, this being due to the presence of the compensating or fork element formed by the pressure tongue 14 and the part 13*a* of the rear section 13. This element tends, in fact, to maintain constant the inclination, one with respect to the other, of the pressure tongue 14 and the part 13*a* and when the former is rotated towards the rear section 13, as an effect of the pressure of the back part 3 (as shown with a continuous arrow in FIG. 6), the part 13*a* of the rear section 13 tends to bend with respect to the remainder of the rear section 13, following in an angular direction the pressure tongue 14 (as shown with a broken line arrow in FIG. 6).

In practice, the rear section 13 is never placed flattened fully on top of the back part 3 since the compensating or fork element creates a discontinuity that tends to cause a greater curve on the end part of the strip, in the region of the back part 3.

It is emphasized that one of the most technically obvious causes for a clip to work loose from a portrait frame can be attributed to the clip flattening on the back of the portrait frame and thereby removing force from the terminal fastening point in the region of the slots 6.

With the clip according to the invention the objects intended to be achieved are indeed realized.

The simplicity of the clip, the functional aspects of the clip and the fact that the clip can be produced in a wide variety of shapes, all of which fully in compliance with the technical characteristics outlined herein, are factors the importance of which is stressed.

Among other things, it is possible to produce the strips provided, as shown for example in FIGS. 2, 4 and 5, with strengthening ribs.

All the component parts can be replaced with others that are technically equivalent.

In practice the materials used, the shapes and sizes can be any depending on the requirements.

What is claimed is:

1. A clip for portrait frames and the like, of the type constituted by a metal strip that deforms elastically and is so shaped as to wrap around one edge of a frame and to place a first terminal part in contact with the front surface of said frame, and to place a second terminal part, at the opposite end to the first terminal part, in the region of a slot made in the outer surface of the back part of said frame, wherein said strip, in the non-operative position, is defined, in between said terminal parts, by two substantially flat sections which form, one with the other, an angle of less than 90°, said sections constituting a covering section, to be placed adjacent to one of said edges on said frame, and a rear section, to be placed adjacent to the back part of said frame, the latter section being provided at one extremity with an integral pressure tongue placed oblique thereto and with a pair of strengthening ribs respectively disposed on opposite sides of said tongue.

2. A clip according to claim 1 wherein said pressure tongue is cut out of said rear section.

3. A clip according to claim 2 wherein said pressure tongue is bent with respect to said rear section in such a way as to point towards said covering section, and wherein said tongue defines, jointly with the part of the rear section adjacent to said second terminal part, a compensating element that tends to maintain virtually constant the position of these.

4. A clip according to claim 1 wherein said terminal parts are bent into a chord of a circle in substantially opposite converging directions.

* * * * *